US009368852B2

(12) United States Patent
Hejase et al.

(10) Patent No.: US 9,368,852 B2
(45) **Date of Patent: *Jun. 14, 2016**

(54) METHOD FOR PERFORMING FREQUENCY BAND SPLITTING

(71) Applicant: INTERNATIONAL BUSINESS MACHINES CORPORATION, Armonk, NY (US)

(72) Inventors: Jose A. Hejase, Austin, TX (US); Rubina F. Ahmed, Austin, TX (US); Daniel M. Dreps, Austin, TX (US); James D. Jordan, Austin, TX (US); Nam H. Pham, Austin, TX (US); Lloyd A. Walls, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/523,685

(22) Filed: Oct. 24, 2014

(65) Prior Publication Data

US 2016/0118703 A1 Apr. 28, 2016

(51) Int. Cl.

| | |
|---|---|
| ***H01P 1/213*** | (2006.01) |
| ***H01P 5/12*** | (2006.01) |
| *H01P 3/16* | (2006.01) |
| *H01P 11/00* | (2006.01) |

(52) U.S. Cl.

CPC *H01P 1/213* (2013.01); *H01P 5/12* (2013.01); *H01P 3/16* (2013.01); *H01P 11/006* (2013.01); *H01P 11/007* (2013.01)

(58) Field of Classification Search

CPC ..... H01P 1/207; H01P 1/213; H01P 11/007; H01P 5/12

USPC ..... 333/135

See application file for complete search history.

(56) References Cited

U.S. PATENT DOCUMENTS

| | | | | |
|---|---|---|---|---|
| 4,783,843 | A | 11/1988 | Leff et al. | |
| 5,668,836 | A | 9/1997 | Smith et al. | |
| 8,483,318 | B2 | 7/2013 | Karlquist | |
| 2005/0040914 | A1* | 2/2005 | Chambelin | H01P 1/2131 333/135 |
| 2008/0208575 | A1 | 8/2008 | Laaksonen et al. | |
| 2010/0109799 | A1 | 5/2010 | Karlquist | |

* cited by examiner

*Primary Examiner* — Benny Lee
*Assistant Examiner* — Albens Dieujuste
(74) *Attorney, Agent, or Firm* — Antony P. Ng; Steven L. Bennett

(57) ABSTRACT

A frequency band splitter is disclosed. The frequency band splitter includes a first, a second, and a third waveguides. A first narrow rectangular waveguide is utilized to connect the first waveguide to second waveguide. The first narrow rectangular waveguide has a first width to allow signals of a frequency band centered around a first frequency to be transmitted from the first waveguide to the second waveguide. A second narrow rectangular waveguide is utilized to connect the first waveguide to the third waveguide. The second narrow rectangular waveguide has a second width, which is different from the first width, to allow signals of a frequency band centered around a second frequency to be transmitted from the first waveguide to the third waveguide.

3 Claims, 4 Drawing Sheets

METHOD FOR PERFORMING FREQUENCY BAND SPLITTING

BACKGROUND OF THE INVENTION

1. Technical Field

The present invention relates to frequency band splitting in general, and, in particular, to a method for performing passive frequency band splitting.

2. Description of Related Art

High-speed signaling systems typically employ multiple single carrier frequency channels to transfer data present within a frequency band from a transmitter (or driver) to a receiver on a printed circuit board. Those single carrier frequency channels are physical channels that are required to maintain wiring rules, such as spacing and density requirements, in order to be able to transmit signals with integrity within a high-speed signaling system.

Instead of using separate physical channels for each carrier frequency signal, a single guiding structure can be utilized to transfer multiple carrier frequency signals. This would require combining and splitting individual carrier frequency signals at the inset and outset of the wave-guiding structure. This approach can be achieved by using frequency division multiplexing methods. To separate signals at the receiving end, a power divider and band pass filters are utilized. Power divided signals are sent to band pass filters, each designed for a specific carrier frequency and associated with a certain receiver. Due to the power division, signals sent to band-pass filters have less amplitude. This approach makes the data signals at each individual receiver more prone to noise. To alleviate the lower signal amplitude characteristic, various amplifiers may be employed; however, this would result in increased costs and resource utilization.

Consequently it would be desirable to provide an improved method to perform frequency band splitting in high-speed signaling systems.

SUMMARY OF THE INVENTION

In accordance with a preferred embodiment of the present invention, a frequency band splitter includes a first, a second, and a third waveguides. A first narrow rectangular waveguide is utilized to connect the first waveguide to second waveguide. The first narrow rectangular waveguide has a first width to allow signals of a frequency band centered around a first frequency to be transmitted from the first waveguide to the second waveguide. A second narrow rectangular waveguide is utilized to connect the first waveguide to the third waveguide. The second narrow rectangular waveguide has a second width, which is different from the first width, to allow signals of a frequency band centered around a second frequency to be transmitted from the first waveguide to the third waveguide.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

I. Theory and Method

Figure 1:
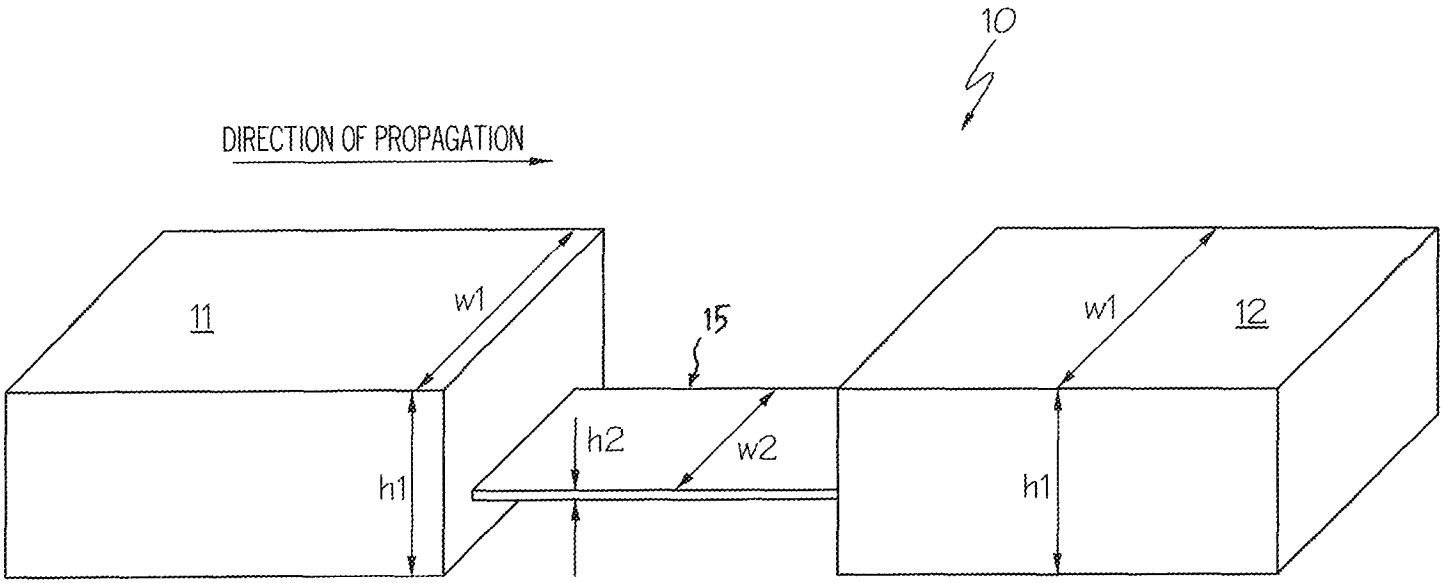
FIG. 1 is a diagram of a wave-guiding structure in which a preferred embodiment of the present invention can be incorporated.

Referring now to the drawings and in particular to FIG. 1, there is illustrated a diagram of a wave-guiding structure in which a preferred embodiment of the present invention can be incorporated. As shown, a wave-guiding structure 10 includes two rectangular metallic waveguides 11 and 12, each having a cross-sectional width w1 and a cross-sectional height h1. Waveguide 11 is connected to waveguide 12 via a narrow rectangular waveguide 15 having a cross-sectional width w2 and a cross-sectional height h2.

Figure 2:
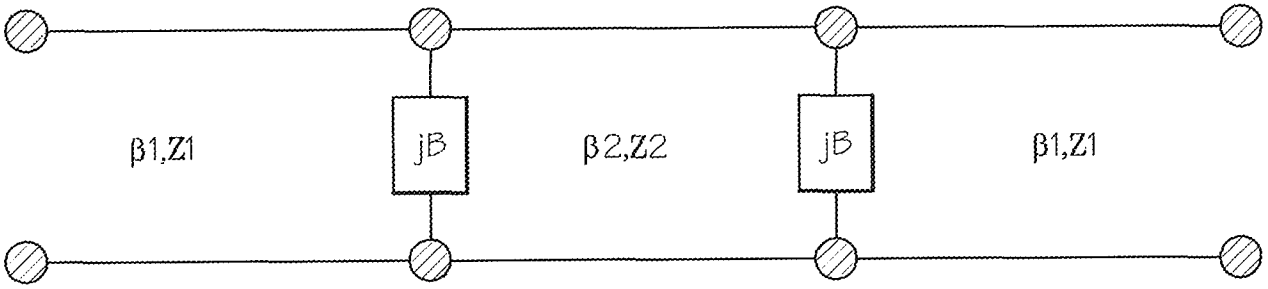
FIG. 2 is an equivalent circuit representation of the wave-guiding structure from FIG. 1.

Wave-guiding structure 10 can be represented as a transmission line equivalent circuit as shown in FIG. 2. In FIG. 2, $\beta 1$ and Z1 respectively represent the propagation constant and the characteristic impedance within waveguides 11 and 12, while $\beta 2$ and Z2 respectively represent the propagation constant and the characteristic impedance within narrow rectangular waveguide 15. In addition, jB is an admittance factor to account for the change in widths and heights at the inset and outset of narrow rectangular waveguide 15.

Consider dominant mode (TE01) wave propagation in waveguides 11 and 12, propagation constant $\beta 1$ can be described as $$\beta 1 = \sqrt{k1^2 - \left(\frac{\pi}{w1}\right)^2} \tag{1}$$

where k1 represents the wave number within waveguides 11, 12 and is described as $k1=2\pi/\lambda 1$, where $\lambda 1$ is the wavelength of the dielectric material filling waveguides 11, 12, which can be expressed as $$\lambda 1 = \frac{c}{f\sqrt{\in 1_r}}$$

where c is the speed of light in free space, f is frequency, and $\epsilon 1$, is the dielectric constant of the material filling waveguides 11, 12. Similarly, the propagation constant $\beta 2$ can be described as $$\beta 2 = \sqrt{k2^2 - \left(\frac{\pi}{w2}\right)^2} \tag{2}$$

where k2 represents the wave number within the waveguide and is described as $k2=2\pi/\lambda 2$, where $\lambda 2$ is the wavelength of the dielectric material filling narrow rectangular waveguide 15, which can be expressed as $$\lambda 2 = \frac{c}{f\sqrt{\in 2_r}}$$

where c is the speed of light in free space, f is frequency, and $\epsilon 2$, is the dielectric constant of the material filling narrow rectangular waveguide 15.

The characteristic impedances of waveguides 11, 12 and narrow rectangular waveguide 15 can be described as $$Z1 = \frac{\pi}{2}\frac{h1}{w1}\frac{k1}{\beta 1}\frac{377}{\sqrt{\in 1_r}} \tag{3}$$

and $$Z2 = \frac{\pi}{2}\frac{h2}{w2}\frac{k2}{\beta 2}\frac{377}{\sqrt{\in 2_r}} \tag{4}$$

Assuming h2<<h1, w2<w1, and $\epsilon 1_r = \epsilon 2_r$, can be thought, at a first glance, that the impedance mismatch between waveguides 11, 12 and narrow rectangular waveguide 15 will lead to almost complete reflection at the interface, resulting in very minute transmission between waveguides 11 and 12. However, the reality is different and may be understood upon examining the global reflection coefficient R due to narrow rectangular waveguide 15.

The global reflection coefficient R can be described as $$R = \frac{\Gamma[1 - e^{-j\cdot 2\cdot \beta 2\cdot d2}]}{1 - \Gamma^2 e^{-j\cdot 2\cdot \beta 2\cdot d2}} \tag{5}$$

where $e^{-j\cdot 2\cdot \beta 2\cdot d2}$ represents the phase shift factor due to wave propagation twice the length of narrow rectangular waveguide 15 in which d2 represents the length of narrow rectangular waveguide 15 along the propagation direction, and $\Gamma$ is the interfacial reflection coefficient between waveguides 11, 12 and narrow rectangular waveguide 15, which is a function of Z1, Z2 and jB.

The main idea behind super tunneling is that a wave can be transmitted (or tunneled) within a narrow frequency band between two transmission lines that are mismatched to a large extent. This may be reached when R=0 by making $$1 = e^{-j\cdot 2\cdot \beta 2\cdot d2} = 0 \tag{6}$$

Equation (6) can be achieved when $\beta 2$ tends to 0. This property takes place at the dominant mode cut-off frequency within narrow rectangular waveguide 15, which is when $$w2 = \frac{c}{2f\sqrt{\in 2_r}} \tag{7}$$

The super tunneling effect resulting from satisfying equation (7) is not dependent on the length of narrow rectangular waveguide 15 or its intermediary shape as long as the width and narrow height relative to the large waveguides are preserved. However, there might exist within a certain frequency band higher frequency tunneling effects due to the Fabry Perot resonance. Unlike the super tunneling effect resulting from satisfying equation (7), such tunneling will depend on, inter alia, the length of narrow rectangular waveguide 15.

II. Frequency Band Splitter Design

Based on the theoretical description in the previous section, a frequency band splitter can be built by connecting a large rectangular waveguide section characterized by a wide frequency band to similar large rectangular waveguide sections using narrow rectangular waveguides each having a different width w. In this case, each narrow rectangular waveguide passes only a narrow frequency band centered around the cutoff frequency f, which results in a $\beta$ tending to 0. Due to reciprocity, this same frequency band splitter can also be utilized as a frequency band combiner (coupler).

Figure 3:
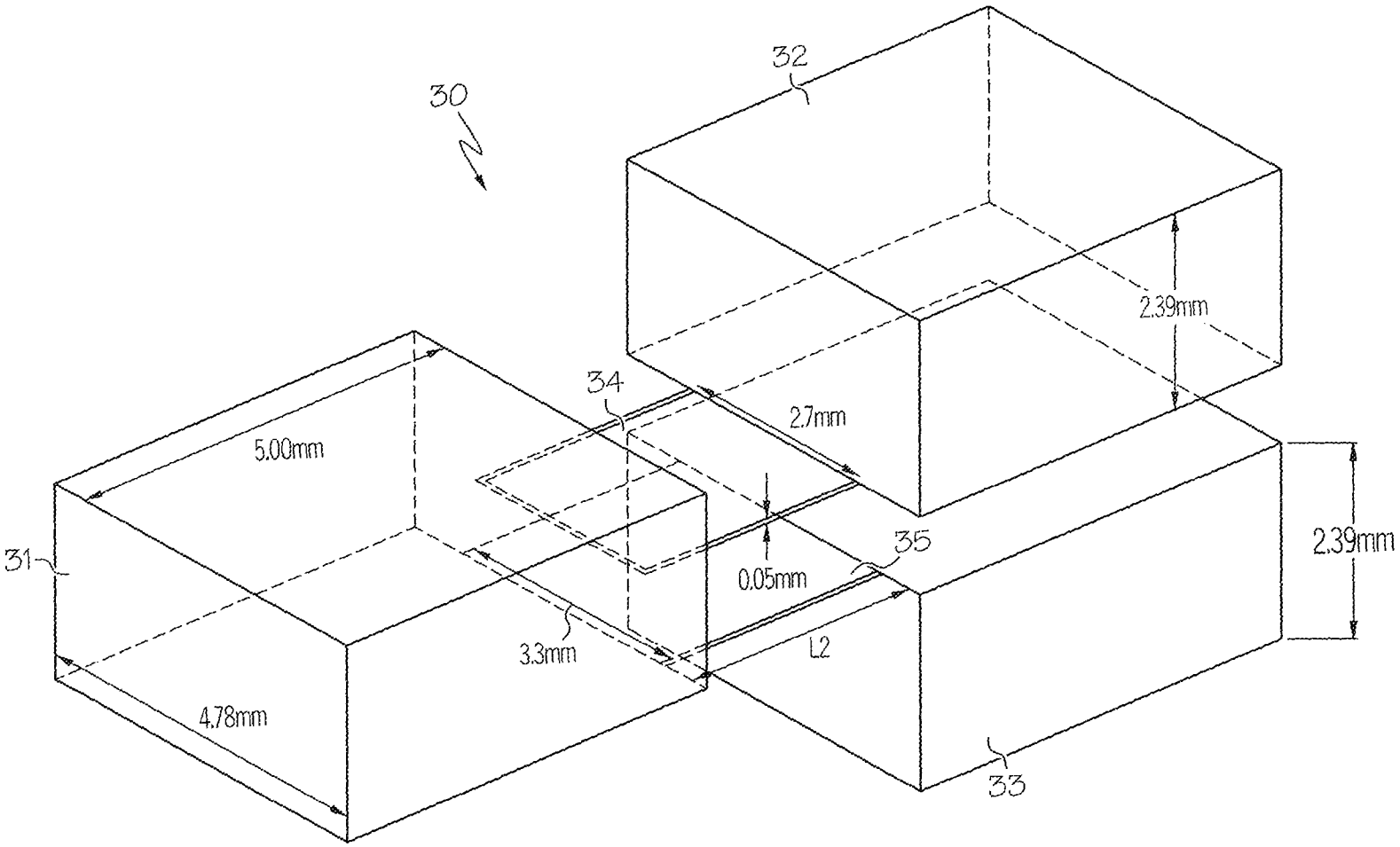
FIG. 3 is a diagram of a two-branch frequency band splitter, in accordance with a preferred embodiment of the present invention.

Referring now to FIG. 3, there is illustrated an exemplary design of a two-branch frequency band splitter, in accordance with a preferred embodiment of the present invention. As shown, a frequency band splitter 30 includes a waveguide 31 connected to two waveguides 32 and 33 via two narrow rectangular waveguides 34 and 35. The height, width and length of waveguide 31 are 2.39 mm, 4.78 mm and 5.00 mm, respectively. The height, width and length of waveguide 32 are 2.39 mm, 4.78 mm and 5.00 mm, respectively. The height, width and length of waveguide 33 are 2.39 mm, 4.78 mm and 5.00 mm, respectively. The height, width and length of narrow rectangular waveguide 34 are 0.05 mm, 2.70 mm and 1.00 mm, respectively. The height, width and length of narrow rectangular waveguide 35 are 0.05 mm, 3.30 mm and 1.00 mm, respectively.

Figure 4:
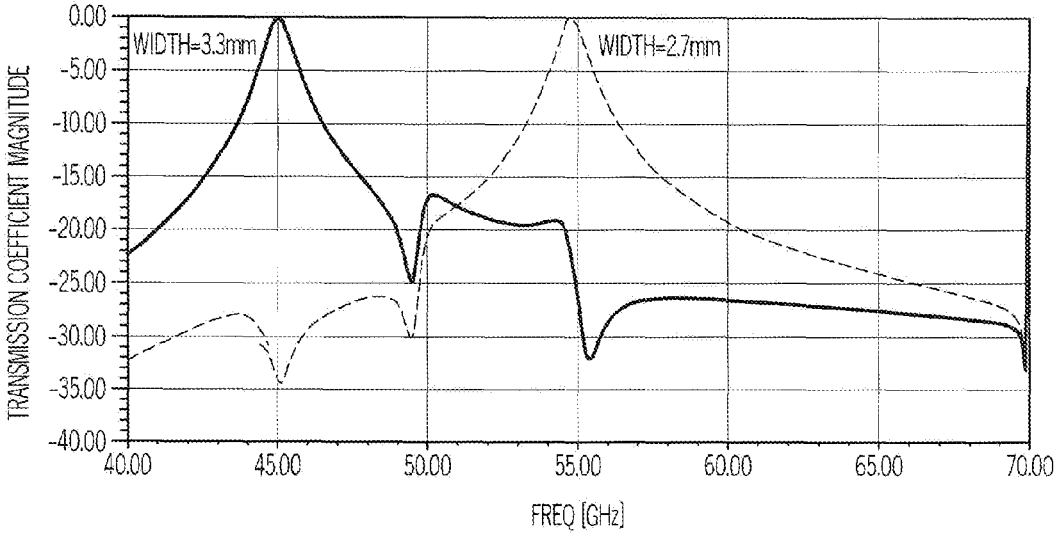
FIGS. 4-5 are graphs showing transmission coefficient magnitudes for the frequency band splitter from FIG. 3.

Waveguide 31 is a U-band (40-60 GHz) waveguide that is the main trunk of the frequency band splitter. Waveguides 34 and 32 compose one branch from waveguide 31 while waveguides 35 and 33 compose a second branch. Like waveguide 31, waveguides 32 and 33 are U-band waveguides. The frequency bands allowed to pass through waveguides 32 and 33 are determined by the width of waveguides 34 and 35 calculated using equation (7) respectively. The amplitudes of the transmission coefficients between waveguide 31 and each of waveguides 32-33 are shown in FIG. 4. The frequency splitting operation of frequency band splitter 30 can be clearly observed in which each branch mainly transmits a specific band with high amplitude.

Figure 5:
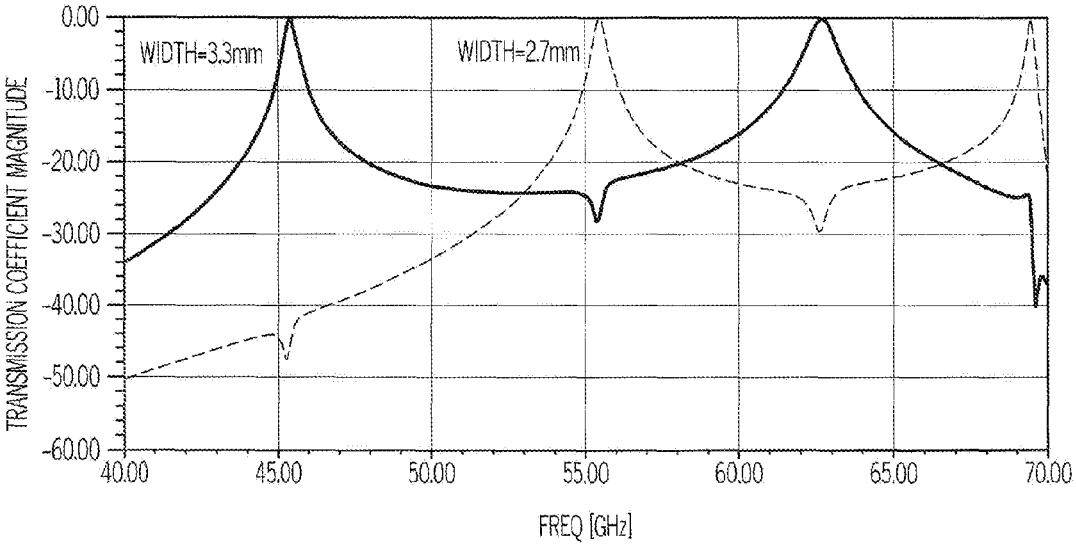

FIG. 5 shows the magnitudes of the transmission coefficient between waveguide 31 and each of waveguides 32-33 with the lengths L of narrow rectangular waveguides 34-35 extended from 1.00 mm to 3.00 mm. The increase in lengths of narrow rectangular waveguides 34-35 did not change the location of the peaks of the frequency split bands corresponding to the widths used to get $\beta$ tending to 0, as shown in FIG. 4. This is expected because under ideal conditions, the lengths of narrow rectangular waveguides 34-35 do not affect the super tunneling frequency achieved with equation (7) (or when $\beta$ tends to 0). Comparing with FIG. 4, the increased lengths of narrow rectangular waveguides 34-35 in FIG. 5 result in less high amplitude frequency band around the super tunneling frequency. In addition, the higher frequency peaks appealing in FIG. 5 in the frequency split band curves are attributed to Fabry Perot resonance effects. These resonance effects are dependent on the lengths of narrow rectangular waveguides 34-35.

As has been described, the present invention provides an improved method for performing passive frequency band splitting in high-speed signaling systems.

While the invention has been particularly shown and described with reference to a preferred embodiment, it will be understood by those skilled in the art that various changes in form and detail may be made therein without departing from the spirit and scope of the invention.

What is claimed is:

1. A frequency band splitter comprising:

a first waveguide;

second and third waveguides, wherein said second and third waveguides have identical heights;

a first narrow rectangular waveguide connected between said first waveguide and said second waveguide, wherein said first narrow rectangular waveguide has a first width to allow signals of a frequency band centered around a first frequency to be transmitted from said first waveguide to said second waveguide; and a second narrow rectangular waveguide connected between said first waveguide and said third waveguide, wherein said second narrow rectangular waveguide has a second width different from said first width to allow signals of a frequency band centered around a second frequency to be transmitted from said first waveguide to said third waveguide.

2. A frequency band splitter comprising:

a first waveguide;

second and third waveguides;

a first narrow rectangular waveguide connected between said first waveguide and said second waveguide, wherein said first narrow rectangular waveguide has a first width, $w_1$, to allow signals of a frequency band centered around a first frequency to be transmitted from said first waveguide to said second waveguide, wherein said first width is related to said first frequency as follows:

$$w1 = \frac{c}{2f_1\sqrt{\in 1_r}}$$

where c is the speed of light in free space, $f_1$ is said first frequency, and $\epsilon 1$, is the dielectric constant of a first material filling said first narrow rectangular waveguide; and a second narrow rectangular waveguide connected between said first waveguide and said third waveguide, wherein said second narrow rectangular waveguide has a second width different from said first width, $w_2$, to allow signals of a frequency band centered around a second frequency to be transmitted from said first waveguide to said third waveguide.

3. The frequency band splitter of claim 2, wherein said second width is related to said second frequency as follows:

$$w2 = \frac{c}{2f_2\sqrt{\in 2_r}}$$

where c is the speed of light in free space, $f_2$ is said second frequency, and $\epsilon 2$, is the dielectric constant of a second material filling said second narrow rectangular waveguide.

* * * * *